US005665257A

United States Patent [19]

Svendsen

[11] Patent Number: 5,665,257

[45] Date of Patent: *Sep. 9, 1997

[54] FLAT BED THERMOPHOTOGRAPHIC FILM PROCESSOR

[75] Inventor: John A. Svendsen, Marine on the St. Croix, Minn.

[73] Assignee: Minnesota Mining and Manufacturing Company, St. Paul, Minn.

[ * ] Notice: The term of this patent shall not extend beyond the expiration date of Pat. No. 5,352,863.

[21] Appl. No.: 553,815

[22] Filed: Oct. 23, 1995

Related U.S. Application Data

[60] Continuation of Ser. No. 289,284, Aug. 11, 1994, abandoned, which is a division of Ser. No. 862,830, Apr. 3, 1992, Pat. No. 5,352,863.

[51] Int. Cl.[6] ..... H05B 1/00

[52] U.S. Cl. ..... 219/216; 219/388

[58] Field of Search ..... 219/216, 388; 355/286, 288; 198/780; 354/299, 337, 319

[56] References Cited

U.S. PATENT DOCUMENTS

| | | | |
|---|---|---|---|
| 1,378,721 | 5/1921 | Rohdiek . | |
| 1,724,645 | 8/1929 | De Long | 101/424.1 |
| 2,157,388 | 5/1939 | MacArthur | 101/424.1 |
| 2,761,365 | 9/1956 | Bridgewater | 219/216 |
| 3,359,404 | 12/1967 | Limberger | 219/216 |
| 3,425,341 | 2/1969 | McGinley | 219/388 |
| 3,471,682 | 10/1969 | Hisey et al. | 219/388 |
| 3,629,549 | 12/1971 | Svendsen | 219/216 |
| 3,648,019 | 3/1972 | Brewitz | 219/386 |
| 3,687,541 | 8/1972 | Aser et al. | 219/216 |
| 3,709,472 | 1/1973 | Kreitz et al. . | |
| 3,739,143 | 6/1973 | Amundson et al. | 219/216 |
| 3,746,448 | 7/1973 | Kitch | 219/216 |
| 3,774,520 | 11/1973 | Smith et al. . | |
| 3,810,735 | 5/1974 | Moser | 219/216 |
| 3,933,514 | 1/1976 | Banks et al. . | |
| 4,161,644 | 7/1979 | Yanagawa et al. | 219/216 |
| 4,182,611 | 1/1980 | Knaak | 432/245 |
| 4,242,566 | 12/1980 | Scribner | 219/216 |
| 4,275,959 | 6/1981 | Jones | 355/20 |
| 4,360,259 | 11/1982 | Burgess et al. | 354/299 |
| 4,389,562 | 6/1983 | Chaudoir | 219/388 |
| 4,397,451 | 8/1983 | Kinoshita et al. | 219/388 |
| 4,518,845 | 5/1985 | Svendsen | 219/216 |
| 4,780,729 | 10/1988 | Murakami et al. | 346/76 PH |
| 4,915,025 | 4/1990 | Miyazaki | 101/424.1 |
| 4,939,992 | 7/1990 | Bird | 101/183 |
| 5,046,264 | 9/1991 | Hultzsch et al. | 34/4 |
| 5,352,863 | 10/1994 | Svendsen | 219/388 |

FOREIGN PATENT DOCUMENTS

| | | | |
|---|---|---|---|
| 0476694A | 3/1992 | European Pat. Off. . | |
| 816380 | 8/1937 | France | 492/56 |
| 1147599 | 3/1985 | U.S.S.R. . | |
| 2176264 | 12/1986 | United Kingdom . | |
| 2186279 | 8/1987 | United Kingdom . | |

OTHER PUBLICATIONS

1500 Dry Diazo Duplicator Brochure by 3M Office Systems Division.

261/262 Duplifiche Printer–Developer Brochure by 3M Office Systems Div.

*Primary Examiner*—Teresa J. Walberg
*Assistant Examiner*—Gregory L. Mills
*Attorney, Agent, or Firm*—William K. Weimer

[57] ABSTRACT

A developer for sheets of dry silver media includes an oven having a film entrance and a film exit. A bed of spaced rollers of low thermal conductivity foam material is positioned within the oven between the entrance and exit. A roller drive mechanism rotates the rollers causing the film to be transported through the oven and developed without visible patterns.

20 Claims, 1 Drawing Sheet

FLAT BED THERMOPHOTOGRAPHIC FILM PROCESSOR

This is a continuation of application Ser. No. 08/289,284 filed Aug. 11, 1994 now abandoned, which is a division of Ser. No. 07/862,830, filed Apr. 3, 1992, now U.S. Pat. No. 5,352,863.

BACKGROUND OF THE INVENTION

The present invention is a method and apparatus for developing sheets of thermophotographic or heat developable film.

Thermophotographic film typically includes a thin polymer or paper base coated with an emulsion of dry silver or other heat sensitive material. Once the film has been imaged, it is developed through the application of heat. Devices and methods for developing thermophotographic film are generally known and disclosed, for example, in the following U.S. Patents:

| Inventor | U.S. Pat. No. |
|---|---|
| Svendsen | 3,629,549 |
| Brewitz | 3,648,019 |
| Kreitz et al. | 3,709,472 |
| Svendsen | 4,518,845 |

The Svendsen U.S. Pat. Nos. 3,629,549 and 4,518,845 both disclose developers having thermally insulating drums concentrically mounted within a heating member. Sheets of film to be developed are engaged by the drum and driven around the heating member. Unfortunately, developers of this type are relatively complicated and poorly suited for use with film having soft emulsions. Since the side of the film bearing the emulsion will contact either the insulating drum or the heating member, the film is subject to damage by sticking or scratching.

The development device disclosed in the Kreitz et al. U.S. Pat. No. 3,709,472 uses a heated drum to develop strips of film, and is not suitable for single sheets of film having soft emulsion layers.

The Brewitz U.S. Pat. No. 3,648,019 discloses a developer with a pair of heaters on opposite sides of a low thermal mass locating device such as a screen assembly. Although it is portable, this developer is relatively slow and poorly suited for commercial applications.

Other thermophotographic film developers include a heated drum which is electrostatically charged to hold the film thereon during development. Since the, side of the film bearing the emulsion is not in contact with the drum or other developer components, it is not subject to sticking or scratching as in some of the developers discussed above. Unfortunately, the electrostatic system used to hold the film on the drum during development is relatively complicated and poorly suited for developers configured to develop larger sized sheets of film.

The 3M Model 261 and 262 thermal diazo processor system uses a belt to transport the film as it is being heated. The belt is a relatively hard, polytetrafluoroethylene (PTFE) coated fiberglass member.

The 3M Model 1500 thermal diazo processor develops rolls of film by transporting the film over a hot drum, in a manner similar to that disclosed in the Kreitz et al. patent discussed above.

In general, and as is discussed in the background sections of the patents referenced above, the density of the developed image is dependant upon the amount of heat to which the film emulsion is exposed. Nonuniform heating ("hot spots") can produce an uneven developed image density. Uneven physical contact between the film, and any supporting structures during the development process can also produce visible marks and patterns on the image.

It is evident that there is a continuing need for improved thermophotographic film developers. In particular, there is a need for a developer capable of quickly and uniformly developing large sheets of film without damaging the emulsion. To be commercially viable, any such developer must be capable of being efficiently manufactured.

SUMMARY OF THE INVENTION

The present invention overcomes problems of known thermal processors of thermophotographic films by providing a thermal processor capable of quickly and uniformly developing sheets of thermophotographic film, including large sheets. One embodiment of the present invention includes an oven having a generally flat and horizontal film transport path. This processor also includes at least three rotatably mounted rollers positioned within the oven along the film transport path for supporting the thermophotographic film. Each of the rollers includes a support rod and polymeric foam surrounding the support rod. This processor also includes a mechanism coupled to the rollers for driving the rollers to transport the thermophotographic film through the oven along the transport path.

Another embodiment of the present invention is an apparatus adapted to develop thermophotographic film by supporting the thermophotographic film as the thermophotographic film is transported through an oven having a generally flat and horizontal film transport path. This apparatus includes at least three rotatably mounted rollers positioned within the oven along the transport path for supporting the thermophotographic film. Each of the rollers includes a support rod and polymeric foam surrounding the support rod.

Still another embodiment of the present invention is a method for developing thermophotographic film having an emulsion on at least one side of the thermophotographic film. This method includes supporting the thermophotographic film generally flatly and horizontally in an oven on at least three rollers. Each of the rollers includes a support tube and polymeric foam surrounding the support tube. The polymeric foam has low density and a low thermal conductivity. This method also includes transporting the thermophotographic film through the oven.

DETAILED DESCRIPTION OF THE PREFERRED EMBODIMENTS

Figure 1:
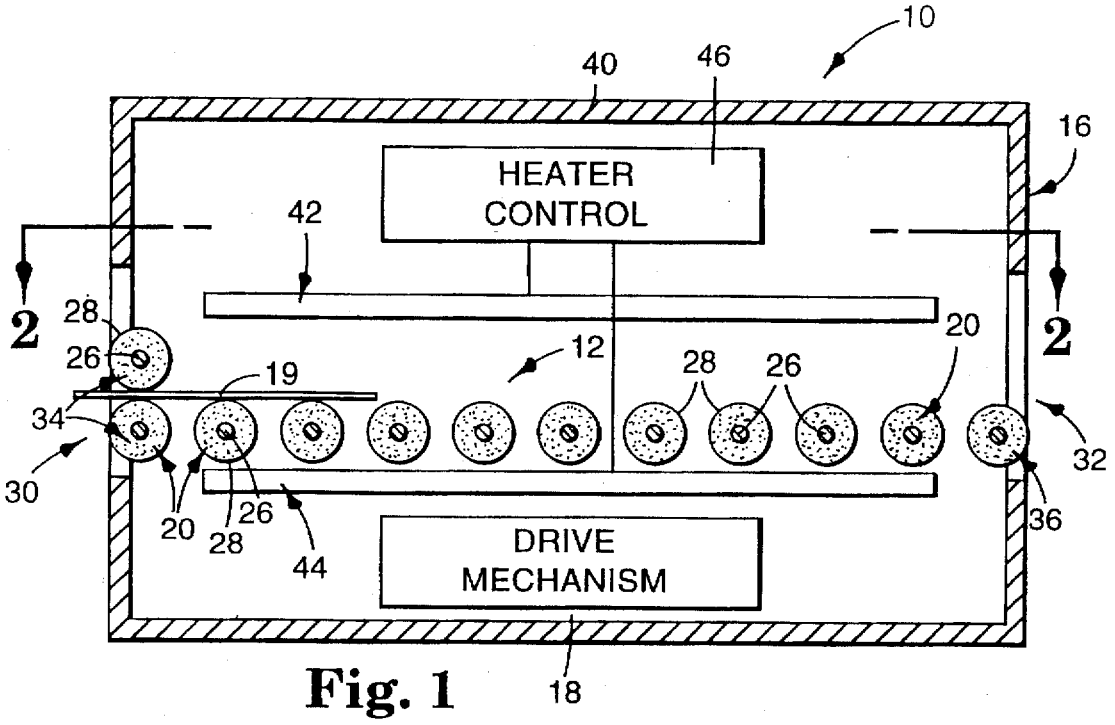
FIG. 1 is a diagrammatic side view of the interior of a developer in accordance with the present invention.
Figure 2:
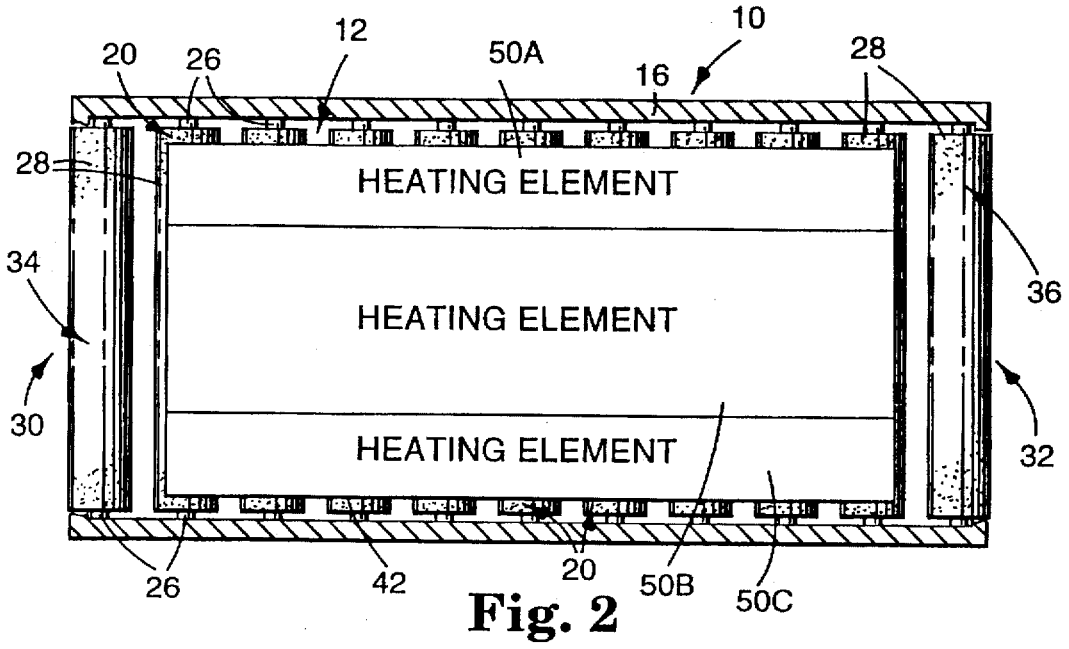
FIG. 2 is a diagrammatic top view of the interior of the developer taken along line 2—2 in FIG. 1.

A dry silver thermophotographic film processor 10 in accordance with the present invention is illustrated generally in FIGS. 1 and 2. Film processor 10 includes a generally flat and horizontally oriented bed 12 of film support material 28 mounted within an oven 16, and a drive mechanism 18 for driving the bed of film support material. As discussed in greater detail below, film support material 28 is a low heat capacity, and typically foam, material which retains insubstantial amounts of heat with respect to that generated by the oven and needed to develop the film. Transporting sheets of film such as 19 through oven 16 on this low heat capacity material 28 allows the film to develop without visible patterns that might otherwise be caused by differentials in the amount of heat, (i.e., "hot spots") to which portions of the film are exposed due to varying physical contact with the transport material. The image on the developed film will therefore have a uniform intensity.

In the embodiment shown, bed 12 is formed by a plurality of elongated rollers 20 (ten are shown). Rollers 20 include support rods 26 with cylindrical sleeves of the film support material 28 surrounding the external surface of the rods. Rods 26 are rotatably mounted to the opposite sides of oven 16 to orient rollers 20 in a spaced, generally parallel relationship about a linear transport path between an entrance 30 and exit 32 of the oven. The generally flat and horizontally orientated nature of bed 12 enables frictional engagement of the bed by sheets of film 19. Oven entrance 30 is a nip formed between a pair of adjacent entrance rollers 34. Entrance and exit rollers 34 and 36 can be identical in structure to rollers 20, and include rods 26 surrounded by sleeves of film support material 28. Rollers 20, 34 and 36 are driven, preferably at the same speed, by drive mechanism 18. In one embodiment (not shown), drive mechanism 18 includes a motor coupled to all rods 26 by a gear linkage.

Oven 16 includes an enclosure 40 with heat sources 42 and 44 mounted above and below bed 12 of rollers 20. The temperature within oven 16 is controlled by heater control 46 which is coupled to both heat sources 42 and 44. As shown in FIG. 2, heat source 42 is a multiple zone source with plural (three are shown) heating elements 50A–50C. Heater control 46 includes a separate controller, such as a RTD controller (not shown), to independently control each heating element 50A–50C. Heat source 44 can be configured and controlled in a manner substantially identical to that of heat source 42. By independently controlling a number of heating elements such as 50A–50C, the temperature within oven 16 can be accurately controlled and maintained.

As noted above, film support material 28 has a sufficiently low heat capacity to prevent any visible patterns on the developed film due to contact with the bed 12. Materials 28 having these characteristics will typically be low density, low thermal mass and low thermal conductivity foam materials. Materials 28 of this type will retain sufficiently low amounts of residual heat that any such heat will not contribute to the development of the film 19. In one embodiment of processor 10, Willtec melamine foam having a density of 0.75 pounds per cubic foot (12.0 kg/m$^3$) and a thermal conductivity (K) of 0.24 British thermal units-inches/hour-foot$^2$-°Fahrenheit is used for support material 28. Material 28 of this type is commercially available from Illbruck Corp. of Minneapolis, Minn. U.S.A. However, many other types of materials having these characteristics, including silicon polyimide foam, can also be used. Furthermore, it is anticipated that materials having even greater heat capacity, density and thermal conductivity than that specified above (e.g., up to 6 pounds per cubic foot (95 kg/m$^3$)) will prevent the development of visible patterns.

In one embodiment, the sleeves of film support material 28 are about 1 inch (2.54 cm) in diameter, and fabricated by coring and grinding a block of stock to a thickness of about 0.25 inch (0.63 cm). The sleeves of material 28 are then mounted to steel rods 26. These rollers 20 are mounted at about 2 inch (5 cm) centers.

Sheets of film 19 can be developed by feeding them into entrance 30 with the emulsion side down, facing rollers 20. This film orientation prevents the film from curling and contacting heat source 42 during development. The dwell time of film 19 within oven 16 (i.e., the speed at which rollers 20 are driven and/or the length of the transport path) and the temperature within the oven are optimized in a known manner to properly develop the film. In one embodiment, processor 10 is operated in such a manner as to expose sheets of film 19 to a temperature in the range of 245° F. to 300° F. (118° to 249° C.) for about 60 seconds. These parameters will, of course, vary with the particular characteristics of the film 19 being developed. Although not shown, a cooling chamber can be positioned adjacent exit 32 of processor 10 to quickly lower the temperature of the developed film 19 for subsequent handling.

Processor 10 offers considerable advantages over those of the prior art. It is a relatively simple and cost effective design, and can be configured to handle large format sheets of film. The processor also facilitates the high quality, (visible) pattern-free development of the film.

Although the present invention has been described with reference to preferred embodiments, those skilled in the art will recognize that changes may be made in form and detail without departing from the spirit and scope of the invention.

What is claimed is:

1. A thermal processor adapted to develop a thermally-developable image in an imaging material, comprising:

a heated oven having an imaging material transport path; and at least three rotating members positioned within the oven along the transport path for supporting the imaging material, the rotating members being heated by the heated oven, the rotating members comprising means for preventing the rotating members from conducting heat to the imaging material in an amount and at a rate sufficient to unevenly develop the image as the rotating members support the imaging material.

2. The thermal processor of claim 1, the preventing means comprising an exterior layer on each of the rotating members, the exterior layer contacting the imaging material when the rotating members support the imaging material, the exterior layer comprising a material having sufficiently low thermal conductivity to prevent the rotating members from conducting sufficient heat to the imaging material to impart a visible development pattern.

3. The thermal processor of claim 2, the preventing means further comprising an internal support member, the internal support member and the exterior layer together having sufficiently low thermal capacity to prevent the rotating members from conducting sufficient heat to the imaging material to impart the visible development pattern.

4. The thermal processor of claim 2, the exterior layer comprising foam having a thermal conductivity of less than about 3 British thermal units-inches/hour-foot$^2$-°Fahrenheit and a density of less than about 95 kilograms per cubic-meter.

5. The thermal processor of claim 1, each rotating member comprising an internal support member, the preventing means comprising an external layer surrounding the internal support member, the external layer having a lower thermal conductivity than the internal support member.

6. The thermal processor of claim 1, the rotating members being positioned generally horizontally within the oven.

7. The thermal processor of claim 1, the rotating members being positioned to contact only one surface of the imaging material.

8. The thermal processor of claim 1, the rotating members being positioned such that the transport path is generally straight.

9. The thermal processor of claim 1, the heated oven being filled with heated gas, the heated gas having a sufficient temperature to develop the thermally developable image.

10. The thermal processor of claim 1, each rotating member comprising a hollow, cylindrical tube and the preventing means comprising a foam layer surrounding each of the hollow, cylindrical tubes.

11. A method for uniformly developing a thermally developable image in an imaging material, comprising the steps of:

providing a heated oven for developing the thermally developable image;

positioning at least three rotating members within the heated oven for supporting the imaging material when transported through the oven, the rotating members being heated by the heated oven; and preventing the rotating members from conducting heat to the imaging material in an amount and at a rate sufficient to unevenly develop the image as the rotating members support the imaging material.

12. The method of claim 11, the imaging material having an imaging emulsion on a first side of the imaging material in which the thermally developable image is formed, the method further comprising the step of transporting the imaging material through the heated oven such that the first side of the imaging material contacts the rotating members.

13. The method of claim 11, the preventing step comprising the step of providing the at least three rotating members with an exterior surface which has a sufficiently low thermal conductivity to prevent the members from conducting sufficient heat to the imaging material to impart a visible development pattern.

14. The thermal processor of claim 13, the exterior surface having a thermal conductivity of less than about 3 British thermal units-inches/hour-foot$^2$-°Fahrenheit and a density of less than about 95 kilograms per cubic meter.

15. The method of claim 11, the preventing step means comprising the step of providing an internal support member and an external layer, the internal support member and the exterior layer together having sufficiently low thermal capacity to prevent the rotating members from conducting sufficient heat to the imaging material to impart a visible development pattern.

16. The method of claim 11, each rotating member comprising an internal support member, the preventing step comprising the step of providing an external layer around the internal support member of each rotating member, the external layer having a lower thermal conductivity than the internal support member.

17. The method of claim 11, the positioning step comprising positioning the rotating members generally horizontally within the oven.

18. The method of claim 11, the positioning step comprising positioning the rotating members such that the transport path is generally straight.

19. The method of claim 11, the heated oven being filled with gas, the method further comprising the step of heating the gas within the oven to a sufficient temperature such that the heated gas develops the thermally developable image.

20. The method of claim 11, each rotating member comprising a hollow, cylindrical tube and the preventing step comprising the step of surrounding each hollow, cylindrical tube with a foam layer.

* * * * *